US007083683B2

(12) United States Patent
Schneidereit et al.

(10) Patent No.: US 7,083,683 B2
(45) Date of Patent: Aug. 1, 2006

(54) APPARATUS FOR THE FORMATION OF COVERINGS ON SURFACES OF SOLID BODIES IN A COATING CHAMBER

(75) Inventors: Hans Schneidereit, Stolpen (DE); Heinz Pritzke, Kesselsdorf (DE)

(73) Assignee: Glatt Systemtechnik GmbH, Dresden (DE)

( * ) Notice: Subject to any disclaimer, the term of this patent is extended or adjusted under 35 U.S.C. 154(b) by 0 days.

(21) Appl. No.: 10/880,489

(22) Filed: Jul. 1, 2004

(65) Prior Publication Data

US 2005/0000418 A1 Jan. 6, 2005

(30) Foreign Application Priority Data

Jul. 1, 2003 (DE) ..... 103 29 813

(51) Int. Cl.
*B05B 3/10* (2006.01)

(52) U.S. Cl. ..... 118/323; 118/320; 239/224

(58) Field of Classification Search ..... 118/303, 118/323, 320, 321; 239/224, 223; 264/4.3, 264/4.4, 4.6, 4.7
See application file for complete search history.

(56) References Cited

U.S. PATENT DOCUMENTS 1,764,437 A * 6/1930 Elsasser ..... 261/88
3,418,971 A * 12/1968 Lamm ..... 118/626
4,562,958 A 1/1986 Busch
4,630,776 A 12/1986 Findling
4,675,140 A * 6/1987 Sparks et al. ..... 264/4.3
4,895,733 A * 1/1990 Imanidis et al. ..... 427/8
5,306,346 A * 4/1994 DiMaio et al. ..... 399/9
5,447,565 A * 9/1995 Song et al. ..... 118/17
5,788,156 A 8/1998 Dopp et al.

FOREIGN PATENT DOCUMENTS

| | | |
|---|---|---|
| DE | 3108292 A1 | 9/1982 |
| DE | 3619857 A1 | 1/1988 |
| EP | 0169486 | 7/1985 |
| WO | 82/03026 | 1/1986 |
| WO | 95/03893 | 2/1995 |

* cited by examiner

*Primary Examiner*—Chris Fiorilla
*Assistant Examiner*—Yewebdar Tadesse
(74) *Attorney, Agent, or Firm*—Jacobson Holman PLLC

(57) ABSTRACT

An apparatus for the forming a covering on surfaces of solid bodies in a coating chamber. The covering is homogeneous and has a constant layer thickness on the surface of the solid bodies while being flexible for use of different liquids including solid materials. A liquid including solid materials is fed to a surface rotating about an axis of rotation, or a surface area of a rotating member. Channel and/or nozzle members forming liquid droplets are arranged on a radially outer edge area of the rotating member.

21 Claims, 2 Drawing Sheets

APPARATUS FOR THE FORMATION OF COVERINGS ON SURFACES OF SOLID BODIES IN A COATING CHAMBER

The priority of German application number 10329813.4, filed Jul. 1, 2003, is claimed under 35 USC §119, the subject matter of which is hereby incorporated by reference in its entirety.

FIELD OF THE INVENTION

The present invention relates to an apparatus for the formation of coverings on surfaces of solid bodies in a coating chamber. As a result, coatings on different bodies can be formed with different geometrical designs as well as different respective dimensions.

Thus, solid particles can be used as coating materials with dimensions in the range of micrometers up to millimeters. However, granules or larger bodies in the range of dimensions of several millimeters up to 30 or even 50 millimeters can be used.

For the formation of the coverings, suitable liquids, in which respective solid materials are included, will be used. Thus, suspensions including solid materials or dispersions can be employed as well.

The respective liquid portion is not allowed only to be a carrier for the solid materials, but may fulfil the function of a binding agent during the formation of coverings on the solid bodies, for example.

Thus, the usable liquids are allowed to not only be inorganic binding agents but also organic binding agents. The liquid may also have a high viscosity, and nevertheless be used in the apparatus according to the invention.

Preferentially, spherically curved solid bodies may be used, and the coverings may be formed on these spherical bodies. At the same time it is also possible to coat hollow spheres by means of subsequent processing steps.

BACKGROUND OF THE INVENTION

Conventionally, such coatings are developed for the formation of coverings on solid bodies by spraying of solid materials with a liquid wherein the respective bodies are moved in order to allow obtaining, if possible, a uniform, complete formation of layers on the entire surface of the bodies.

Heretofore, the liquid and solid materials were sprayed upon the moving bodies. This is carried out by means of nozzles. According to the prior art, tangential nozzles were acceptable for such applications.

As a result, there are different ways for coating solid bodies. On the one hand, solid materials and the liquid employed are sprayed through separate nozzles in a separate way. Alternatively, it is also possible for this to be carried out through so-called two-component nozzles in which liquid suspensions are used. On that occasion, problems occur in that there is no uniform local distribution of liquid within a coating chamber, and consequently there is a non-uniform and even an inhomogeneous coating formed during the formation of the coverings. Furthermore, agglomeration cannot be completely avoided in the nozzles causing blockages.

The nozzles which are known tend to become blocked which in turn results in operational failures or in non-uniform coatings and coverings.

Furthermore, there are limitations with respect to the usable liquids since high-viscous liquids cannot be sprayed very easily.

For the attainment of small dimensions of liquid droplets and/or increased spraying rates, it is frequently required to additionally use a compressed gas together with the liquids including solid materials which in turn results in turbulences within the coating chamber and in the non-uniform formation of layers.

Furthermore, with the solutions known up to now, high proportions of solid bodies cannot be unlimitedly used in the liquid.

If dispersions are fed through the conventional nozzles then increased wear on the nozzles is to be noted.

Furthermore, the respective nozzles used are adjusted toward particular consistencies of a liquid and equivalent viscosities such that substitution of the nozzles is required when using different liquids.

SUMMARY OF THE INVENTION

Thus, it is an object of the present invention to form coverings having increased homogeneity and constant layer thickness while obtaining an enhanced flexibility of use of liquids including solid materials formed on surfaces of solid bodies within coating chambers.

Thus, the apparatus according to the present invention is formed having at least one rotating member.

On the rotating member, there is a surface or at least a surface area rotating about an axis of rotation. The surface or surface area can be aligned preferably orthogonally to the axis of rotation.

However, there is also a possibility that the surface or the surface area will be conically inclined relative to the axis of rotation. For example, the surface or the surface area may constitute a hollow cone. This hollow cone can be formed in a tapered downward manner in a vertical direction such that the liquid and/or solid material can be accelerated radially outwardly and in an ascending manner, and then the liquid containing solid material is allowed to come out through a channel and nozzle members formed therein.

The liquid including solid materials is fed upon the aligned surface or the surface area, and is accelerated radially outwardly due to the centrifugal forces acting on the surface and surface area, respectively.

The channel and/or nozzle members forming liquid droplets are arranged on the radially outer marginal area of the respective rotating member through which the liquid including solid materials is atomized in a drop shape in the coating chamber. Thus the coverings can be formed on the respective surfaces of the solid bodies which are fixed in position inside the coating chamber.

The liquid is fed through at least one feed pipe toward the surface and the surface area, respectively. This is accomplished by means of correspondingly arranged and aligned apertures of liquid feed pipes of a dispensing arrangement.

However, liquid feeding can also take place through a hollow drive shaft for the respective rotating member with exit ports correspondingly arranged/formed on the hollow drive shaft.

The liquid feeding is exclusively allowed to occur by gravitational forces. Should the need arise, there is the possibility to support liquid feeding with accordingly small nozzles which can be used, for example, with a very slight increased air pressure in a storage container for the respective liquid.

A common supply of liquid and pressurized air, as an example of a compressed gas, is not necessarily required.

It is advantageous to align the axis of rotation of a rotating member vertically, and then to align the respective surface and the respective surface area of a rotating member horizontally.

Sufficient centrifugal forces are obtained at rotational speeds of the rotating member of at least 5000 revolutions per minute. The radius along which the channel and/or nozzle members are arranged around the axis of rotation is significantly below 500 mm.

The present invention can operate at higher rotational speeds. Accordingly a reduced respective radii or diameter of the rotating members will be used.

Nevertheless, the apparatus according to the present invention is allowed to include a pressurized air supply. At the same time, a pressurized air feeding is not used initially when dispensing the liquid including solid materials, and in particular it should not be utilized for atomizing the liquid including solid materials.

Thus, on the one hand, it is possible to provide a pressurized air feeding in a casing in which the drive for the rotating member is housed. As a result, cooling for the drive can be achieved. Furthermore, liquid, dirt or other solid materials are prevented from penetrating into the casing and affecting the drive shaft of the rotating member.

However, pressurized air feeding can also take place by itself or in addition to the pressurized air feeding already mentioned, through a hollow drive shaft for the rotating member. Because of that, pollution affecting the drive shaft can be avoided.

In the following, a first embodiment for a rotating member shall be described in more detail.

On this rotating member is formed a surface area aligned orthogonally to the axis of rotation of the rotating member. On a radially outer edge of this surface area, a second surface area is located which is outwardly directed at an obliquely inclined angle, and on the radially outer edge of which in turn a channel is formed and/or nozzle members are formed.

The second surface area is preferably directed upwardly such that the motion of liquid as directed by centrifugal forces is correspondingly redirected. Because of this, the formation of liquid droplets is made in a homogeneous form and the spraying pattern formed inside the coating chamber can be advantageously effected.

In order to avoid undesired liquid leakage, it is advantageous to provide on the rotating member a liquid returning flange which is formed around the drive shaft, and on the radially outer surface of which excessive liquid is allowed to drain off and drip on a surface area of the rotating member, and to be accelerated from there once again towards the channel and/or nozzle members as determined by centrifugal forces.

Such a formation of a rotating member with the two surface areas and the liquid returning flange can be designated as a rotating spray chamber.

In a second alternative, however, a rotating member can also be formed such that a conical member is opened in one direction and is arranged on the rotating member. The cone angle of such a conical member is selected such that the aperture directed towards the solid bodies to be coated has a greater diameter than adjacent to the drive motor.

The surface of such a rotating member which is orthogonally directed to the axis of rotation then comprises on its radially outer-edge the respective channel and/or nozzle members through which the liquid being already in a finely spread drop shape will be accelerated, as determined by centrifugal force towards an inner circumferential surface of the conical member and will impinge thereon and be accelerated and distributed within the coating chamber.

With such an alternative embodiment of an apparatus according to the invention, the rotating member then forms a kind of spray chamber within the conical member.

The channel and/or nozzle members should be arranged each in equidistant angular distances to each other. The plane diagonal or diameter of the clear cross sections of these members are in the range of between 0.3 mm and 3 mm, preferably in the range of 0.5 mm to 1.5 mm.

Preferentially, at least two liquid feeding tubes can be used in an apparatus according to the invention. These should be arranged diametrically opposing each other relative to the axis of rotation, and if possible equidistant from the axis of rotation. The respective liquid can therefore be deposited more consistently upon the surface and surface area of the rotating member, respectively, and a uniform effect of the centrifugal forces can be maintained when equal distances with respect to the axis of rotation are used.

Furthermore, there is the possibility of using a cleaning liquid to be able to carry out cleaning of the apparatus, for example, in certain predeterminable time intervals or when changing to another liquid.

Thus, the cleaning liquid is allowed to be fed from a storage tank via a separate feeding of cleaning liquid or alternatively by opening and closing valves, respectively, to immediately feed the cleaning liquid via the dispenser or feeding tube(s) used for the liquid forming the covering formation.

Alternatively, the apparatus according to the invention may comprise more than one rotating member. The possibility then arises of forming multilayered coverings on solid bodies within one batch in the same coating chamber. Thus, by means of an equivalent connection of valves, at first a liquid having a certain consistency can be fed to a rotating member. The solid bodies are coated in the coating chamber, and a first layer of covering can be formed. Should the occasion arise, after intermediate drying, the feeding of this first liquid can be shut off, and a second liquid can be fed to the respective second rotating member to obtain a surface coating upon the first layer already formed on the bodies for production of a two-layered covering on the solid bodies.

However, the apparatus according to the invention may also be used such that liquid and solid material will be fed through feed pipes separate from each other. Mixing takes place immediately in the apparatus with simultaneous acceleration as determined by centrifugal forces.

In this connection, a certain arrangement of the respective feed pipes or tubes assists the mixing effect of the liquid dispensing arrangement.

Thus, for example, a feed pipe for liquid or solid materials can be arranged at a greater radius than another feed pipe. Considering the rotational speed of the rotating member, equivalent angular misalignment can be additionally provided as well.

Alternatively, feeding of liquid and/or solid material can be assisted by means of a compressed gas which is allowed to immediately pass around the rotating member.

In the simplest case, pressurized air can be used. However, it is also possible to use a reactive or an inert gas for utilizing chemical reactions or preventing such chemical reactions during the formation of desired coverings on the bodies.

An improved thorough mixing of liquid and solid materials, and should the occasion arise, additional regulation of the droplet size can be achieved with impact (or deflection) bodies. Impact bodies are arranged between the respective feeding area for liquid and/or solid material and the channel and/or nozzle members arranged radially outwardly such that liquid containing solid material will be accelerated at first against such impact bodies before they are moved further radially outwardly and are allowed to pass through the channel and/or nozzle members.

The impact bodies can be arranged statically with a relatively small gap in a widthwise direction with respect to the rotating portion of the apparatus.

However, there is also a possibility to provide impact bodies on the rotating member, for example, on the surfaces and surface areas, respectively.

The coating chamber in which an apparatus according to the present invention is used is a conventional fluidized process chamber.

Alternatively, the apparatus according to the invention can be used in coating chambers in which rotating containers are arranged. Then, in these rotating containers the respective solid bodies to be provided with coverings can be accommodated and moved during coating by the apparatus according to the invention, and should the occasion arise, during intermediate drying or secondary drying.

With the solution according to the present invention, substantial disadvantages which were in the prior art, can be eliminated or at least considerably reduced.

Thus, different liquids having a high viscous form (up to 10000 mPas) and such, including high proportions of solid material as well can be readily used. Blockages of nozzles do not occur, and a uniform homogeneous coating of the surfaces of solid bodies can be achieved such that uniformly thick coverings which are formed with a uniform consistency can be obtained on solid bodies.

High coating rates can be achieved, and great volumes are allowed to be covered in the coating chambers.

The apparatus according to the invention operates in an almost wear-resistant manner.

The coating process can be affected in wide degrees by the regulation and control of the rotational speed of the rotating members which is realizable in a relatively simple manner without requiring expensive retrofits.

BRIEF DESCRIPTION OF THE DRAWINGS

The invention shall be explained in more detail by way of example, in which.

DETAILED DESCRIPTION OF THE PREFERRED EMBODIMENTS

Figure 1:
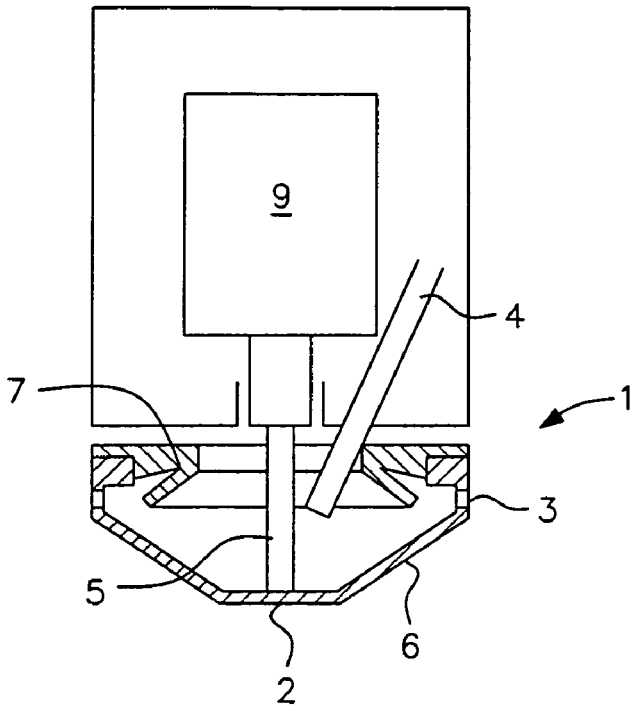
FIG. 1 shows a first example of the apparatus according to the invention in a schematic form.
Figure 2:
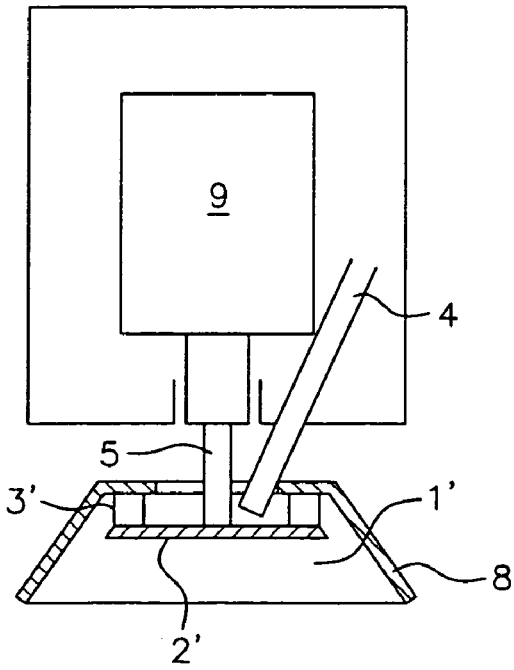
FIG. 2 shows a second example in a schematic form.

In the example of an apparatus according to the invention shown in FIGS. 1 and 2, a coating chamber is not shown.

The example of an apparatus according to the invention shown in FIG. 1 comprises a rotating member 1 which can be rotated by means of a drive shaft 5 of a driving motor 9.

The driving motor 9 is an electric motor, however, an air-powered motor or a hydraulic motor may be used as well. With the driving motor 9, sufficient rotational speeds for the rotating member 1 are obtained.

In this example, the drive shaft 5 for the rotating member 1 is aligned vertically, and a surface area 2 aligned orthogonally to the axis of rotation of the drive shaft 5 is shown on the rotating member 1.

Liquid, including solid material, passes from above through the liquid feeding tube or dispensing device 4 towards the surface area 2 and is accelerated radially outwardly by centrifugal force.

A second surface area 6 extends radially from the first surface area 2 and is aligned at an obliquely upwardly inclined angle with respect to the first surface area 2. Liquid accelerated by centrifugal force is fed toward the nozzle or channel members 3 of the dispensing device which are uniformly circumferentially arranged. Small droplets develop and are sprayed through the nozzle or channel members at an almost constant droplet size into a coating chamber surrounding the rotating member 1 within which objects to be coated are positioned.

To avoid undesired leakage of liquid from the rotating member 1, a liquid returning flange 7 encircling the drive shaft 5 is shown. With the liquid returning flange 7, it is possible to prevent excessive liquid, for example, from passing into the area of the drive shaft 5 or even into the casing for the driving motor 9.

In the illustrated example, one portion of the liquid returning flange 7 is directed at a radially outwardly extending obliquely inclined angle such that excessive liquid is allowed to drip onto the second surface area 6.

In the example of an apparatus according to the invention which is shown in FIG. 2, an area 2' orthogonally aligned with respect to the drive shaft 5 is a component of a rotating member 1' which is connected to the drive shaft 5.

The liquid including solid materials passes through the liquid feeding tube of the dispensing device 4 onto the surface of area 2'. The liquid is accelerated radially outwardly by centrifugal force.

On a radially outer edge of surface 2' there are channel and/or nozzle shaped members 3' through which liquid being accelerated passes.

A conical member 8 is additionally provided on the rotating member 1'. The hollow conical member 8 is aligned such that an aperture of the conical member opens outwardly towards the solid bodies to be coated and increases in diameter in a direction away from motor 9. A top portion of the conical member 8 then forms an upper seal for the rotating member 1'.

Figure 3:
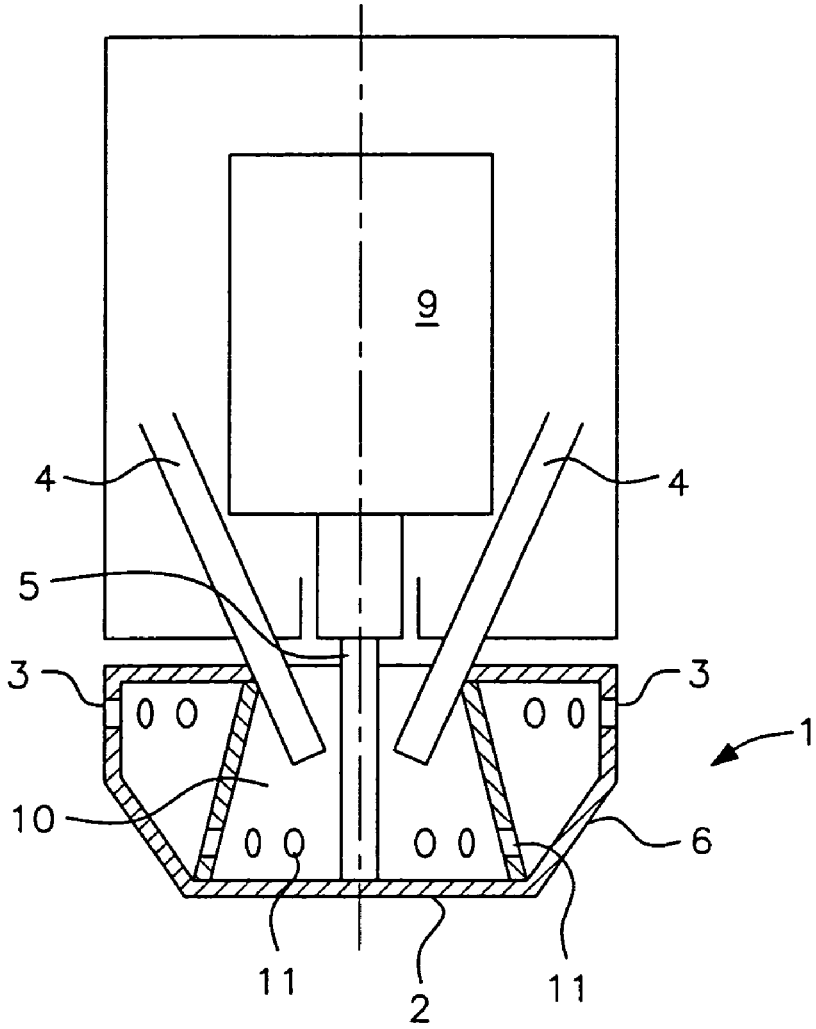
FIG. 3 shows a third example with an additional mixing chamber.

The example shown in FIG. 3 is similarly formed as the example according to FIG. 1. In the rotating member 1 there is a mixing chamber 10 into which liquid and/or solid materials, each separated or together are fed via feed pipes 4 to the rotating body 1.

An encircling flange encloses the drive shaft 5 of the rotating member 1. The mixture consisting of liquid and solid materials is allowed to come out through channel and/or nozzle members 11 formed on the outer wall of the mixing chamber. The liquid and solid materials are accelerated upwardly from the conical surface 6 towards the channel and/or nozzle members 3 such that the liquid and solid materials are then allowed to pass in a homogeneously distributed droplet shape into the coating chamber within which objects to be coated are positioned.

Particularly in cases in which solid material is fed through separate feed pipes 4, it is advantageous to feed solid material with a compressed gas to achieve a certain degree of fluidizing such that blockages can be avoided.

It is possible to drive a rotating member 1 by a flexible shaft which may be advantageous in particular with the available spatial proportions being restricted.

The arrangement of the exit ports of these liquid feeding tubes 4 with respect to the surface of surface area 2 or surface 2', is controlled by adjusting a respective gap width between the exit parts and the surfaces 2 or 2'. It is thereby possible to influence the volume flow rate of the liquid including solid materials fed at a time without employing control valves which could regulate the flow amounts of liquid containing solid materials.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. An apparatus for forming a covering on a surface of a solid body in a coating chamber, said apparatus comprising:

a rotating member having an axis of rotation and a first surface portion, said first surface portion being rotated about the axis of rotation and being aligned orthogonally to said axis of rotation, a liquid including solid materials to be fed to the first surface portion of the rotating member, a feeding pipe having an exit port for directing the liquid towards said first surface portion, a gap located between said exit port and said first surface portion being adjustable, said rotating member including a second surface portion inclined at an angle and directed radially outwardly from the first surface portion, and a droplet dispensing portion of said rotating member forming droplets from the liquid, said droplet dispensing portion being located on a radially outer edge area of the second surface portion of said rotating member.

2. The apparatus according to claim 1, wherein said second surface portion extends conically with respect to said axis of rotation.

3. The apparatus according to claim 1, wherein said liquid is fed through at least one feed pipe for directing the liquid to the first surface portion of said rotating member.

4. The apparatus according to claim 1, wherein said droplet dispensing portion is connected to a hollow drive shaft of the rotating member.

5. The apparatus according to claim 1, wherein said axis of rotation of said rotating member is vertically aligned and said surface portion is horizontally aligned.

6. The apparatus according to claim 3, wherein said at least one feed tube includes a compressed gas.

7. The apparatus according to claim 1, wherein compressed gas is present within a hollow drive shaft of said rotating member.

8. The apparatus according to claim 4, wherein said rotating member includes a liquid returning flange formed around said drive shaft.

9. The apparatus according to claim 8, wherein said rotating member forms a rotating spray chamber with said liquid returning flange.

10. The apparatus according to claim 1, wherein said rotating member includes a conical member open in one direction.

11. The apparatus according to claim 10, wherein said droplet dispensing portion is arranged on a radially outer edge within said conical member.

12. The apparatus according to claim 10, wherein said droplet dispensing portion forms a spray chamber within said conical member.

13. The apparatus according to claim 1, wherein said droplet dispensing portion includes nozzle members arranged equidistant to each other.

14. The apparatus according to claim 3, wherein said at least one feed pipe includes two liquid dispensers arranged diametrically opposite to each other relative to said axis of rotation and equidistant to said axis of rotation.

15. The apparatus according to claim 14, wherein cleaning liquid can be fed through said liquid dispensers.

16. The apparatus according to claim 1, wherein a minimum rotational speed of the rotating member is 5000 rpm.

17. The apparatus according to claim 1, wherein there are two rotating members, each having a separate liquid dispensing device.

18. The apparatus according to claim 1, wherein said liquid and said solid materials are fed through separate feed pipes.

19. The apparatus according to claim 18, wherein feeding of said liquid and said solid materials is assisted by a compressed gas.

20. The apparatus according to claim 18, wherein impact bodies are arranged between a feeding area for said liquid and said droplet dispensing portion.

21. The apparatus according to claim 1, further comprising a mixing chamber including said droplet dispensing portion is present on said rotating member.

* * * * *